US005139234A

United States Patent [19]

Cochrane

[11] Patent Number: 5,139,234

[45] Date of Patent: Aug. 18, 1992

[54] FENCING COMPONENT

[75] Inventor: Richard B. Cochrane, Sandton, South Africa

[73] Assignee: Cochrane Steel Products, Limited, Johannesburg, South Africa

[21] Appl. No.: 721,782

[22] Filed: Jun. 26, 1991

[51] Int. Cl.[5] ..... B21F 25/00

[52] U.S. Cl. ..... 256/8; 256/33; 256/2

[58] Field of Search ..... 256/8, 7, 33, 2

[56] References Cited

U.S. PATENT DOCUMENTS 2,908,484 10/1959 Uhl ..... 256/8
3,155,374 11/1964 Sieffert ..... 256/2
4,666,129 5/1987 Dobson ..... 256/8 X
4,915,359 4/1990 Cochrane ..... 256/8 X

FOREIGN PATENT DOCUMENTS 603941 10/1934 Fed. Rep. of Germany ..... 256/2
480082 2/1938 United Kingdom ..... 256/33

*Primary Examiner*—Andrew V. Kundrat
*Attorney, Agent, or Firm*—Lowe, Price, LeBlanc & Becker

[57] ABSTRACT

A fencing component is made from substantially co-planar loops of barbed tape which overlie each other and which are progressively spaced apart in a first direction. The sizes of the loops are chosen so that the overlying loops form apertures of desired sizes.

8 Claims, 1 Drawing Sheet

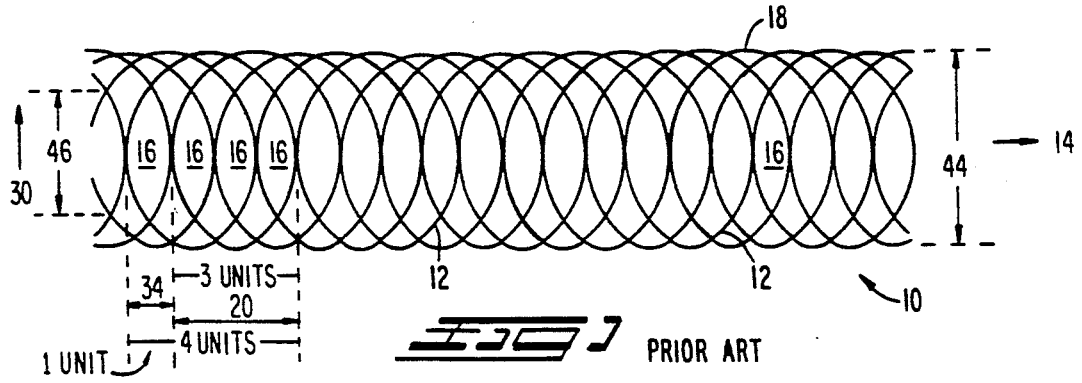
FIG 1 PRIOR ART
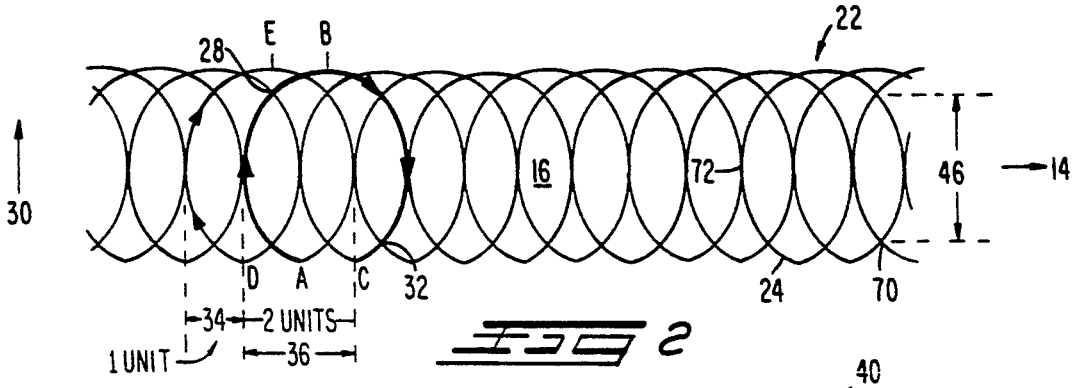
FIG 2
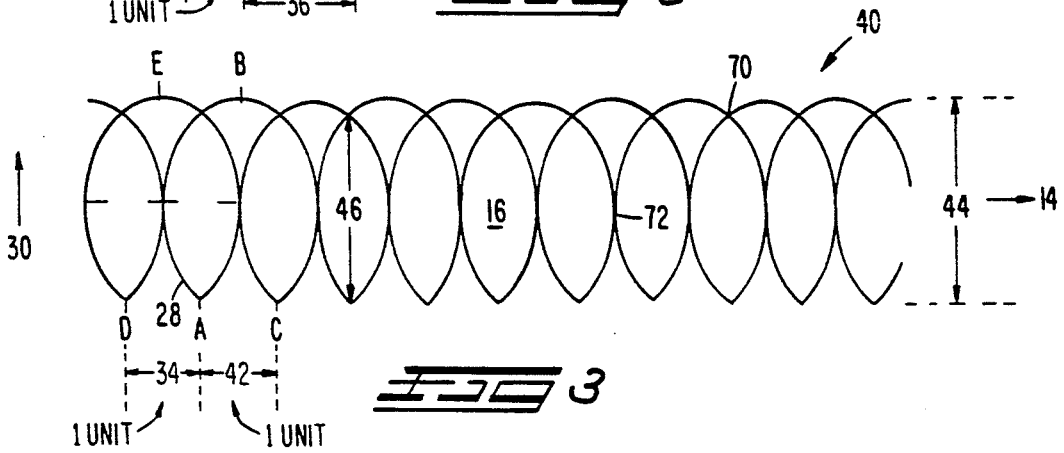
FIG 3
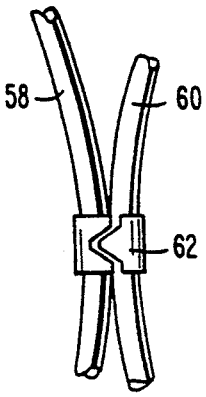
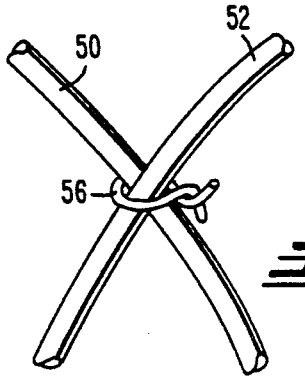
FIG 4
FIG 5

FENCING COMPONENT

FIELD OF THE INVENTION

BACKGROUND OF THE PRIOR ART

This invention relates to a fencing component.

In the specification of South African patent No.88/6395 there is described a fence which is made from a coil of barbed tape with the individual loops of the coil substantially co-planar and partly overlapping one another.

The loops are arranged in a particular configuration so that they define apertures of a predetermined size. The resulting assembly of co-planar loops forms an effective barrier but a substantial amount of barbed tape is used in the fabrication of the barrier.

SUMMARY OF THE INVENTION

It is an object of the present invention to provide a barrier or fencing component of the aforementioned kind wherein substantially less material is used.

The invention provides a fencing component which comprises a plurality of substantially co-planar loops of barbed tape which are progressively spaced from one another in a first direction and which overlie one another, and means securing overlying portions of the loops to one another, and wherein each loop comprises a first curved section which extends generally in a forward direction which is transverse to the first direction, and a second curved section which extends generally in a return direction which is transverse to the said first direction, the first curved section of each loop being spaced from the first curved section of a preceding loop by a predetermined first distance and from the second curved section of the preceding loop by a second distance which is less than three times the said predetermined first distance.

In one form of the invention, the second distance between the first curved section of each loop and the second curved section of a preceding loop is twice the said predetermined first distance. It has been found that this embodiment of the invention is particularly suitable when the width of each loop, in a direction which is transverse to the said first direction, is greater than about 550 mm.

In a second form of the invention the second distance between the first curved section of each loop and the second curved section of a preceding loop is equal to the said predetermined first distance. This embodiment finds particular application where the width of each loop, transverse to the said first direction, is less than about 650 mm.

The securing means may include a plurality of metallic bands which respectively secure central portions of the second curved sections of the loops to central portions of the first curved sections of respective preceding loops.

The securing means may include a plurality of wire ties which respectively secured overlying portions of the loops to one another.

The fencing component may be formed from a helical coil of barbed tape which is extended and then arranged so that the loops of the coil are substantially co-planar.

BRIEF DESCRIPTION OF THE DRAWINGS

The invention is further described by way of examples with reference to the accompanying drawings in which:

FIG. 1 schematically depicts in plan a prior art fencing component,

FIGS. 2 and 3 are views similar to FIG. 1 of fencing components according to the invention, and FIGS. 4 and 5 respectively show on an enlarged scale portions of the fencing component of FIG. 2 illustrating the way in which adjacent or overlying portions of barbed tape are secured to one another.

DESCRIPTION OF PREFERRED EMBODIMENTS

A primary objective of the present invention is the provision of a fencing component which uses less material than a prior art fencing component, and which consequently is less expensive and weighs less. The efficacy of the fencing component, from the security point of view, must not however be compromised unduly.

FIG. 1 illustrates a prior art fencing component 10 which is made from a length of barbed tape which is wound in flat spiral form with a plurality of overlying loops 12.

From an examination of any individual loop in the fencing component of FIG. 1, it can be seen that as a loop is wound it advances in a longitudinal direction 14 by four units or length and then returns in a direction which is opposite to the direction 14 by a distance of three units. In so doing a number of central apertures 16 are formed with the width of each aperture, measured in the longitudinal direction 14, being one unit.

A plurality of additional smaller apertures 18 are formed along the longitudinal sides of the loops and consequently a relatively large amount of the barbed tape material is used along the sides. The smaller loops do not however add materially to the deterrent value of the fencing component for this primarily is determined by the sizes of the largest loops 16 and, as pointed out, these are one unit wide (as indicated by the distance 34 in FIG. 1) in the direction 14. The length 46 of each aperture 16 along a direction 30 which is transverse to the direction 14 is mainly determined by the width 44 of the loops in that direction 30.

FIG. 2 shows a fencing component 22 according to a first form of the invention, which is formed from a coil of barbed tape which comprises a plurality of helical loops in tubular form. The helical coil is extended and the individual loops are then laid so that they overlie adjacent loops and are thus arranged in a substantially co-planar array defined by the combined thicknesses of the overlaid loops.

In FIG. 2 the individual loops, designated 24, are progressively spaced with respect to one another in a direction 14 and overlie one another. Each loop comprises a first curved section 28, which is marked A–B for ease of identification and on a boldly shown loop, which extends generally in what is designated as a transverse direction 30, i.e., one that is transverse to the forward direction 14, and a second curved section 32 which is marked B–C for ease of identification and which extends generally in a return direction which opposes the direction 30.

The first curved section 28 of each loop is spaced from the first curved section (DE) of a preceding loop by a distance 34, which is referred to as being one unit in length, and from the second curved section (EA) of the preceding loop by a distance 36 which, in this embodiment of the invention, is twice the distance 34 i.e. is equal to two units. The distance in the prior art per FIG. 1, which corresponds to the distance 34 in the form of this invention per FIG. 2, is the distance 20.

With the fencing component 40 of FIG. 3 the construction differs from the construction of the component of FIG. 2 in that although the first curved portion 28 of each loop is spaced from the first curved section of a preceding loop by a distance 34, which is equal to one unit of length, it is spaced from the second curved section of the preceding loop by a distance 42 which is equal to the distance 34 and which is also therefore one unit in length.

The width of each main aperture 16 in the fencing component 40, as determined in the direction 14 in each form of the invention, is consequently one unit of length and, as with the FIG. 2 embodiment, its length in a direction 30 transverse to the direction 14 is determined substantially by the overall width 44 of the coils in the direction 30.

From a comparison of the fencing components of FIGS. 2 and 3 with the fencing component shown in FIG. 1 it can be seen that the lengths 46 of the main apertures 16 normal to the direction 14 increase as the loop density, i.e., number of loops/length in direction 14, decreases. Similarly the outermost apertures 18 increase in size and decrease in number as the amount of barbed tape used per unit length in the direction 14 decreases. Nonetheless as long as the width 34 of each main aperture 16, in the direction 14, remains the same at one unit of length the overall efficacy of the fencing component of FIGS. 2 and 3 is not seriously affected.

The fencing component of FIG. 1 is most vulnerable in the region of each principal aperture 16. The peripheral apertures 18 are much smaller and penetration of the barrier is not likely at the peripheral apertures. The same applies to the fencing components of FIGS. 2 and 3. As will be appreciated from consideration of FIGS. 1, 2 and 3 together, the dimension 46 increases slightly from FIG. 1 to FIG. 2 and from FIG. 2 to FIG. 3 even as the dimension 44 decreases somewhat in corresponding comparisons for a fencing component formed of loops of a given length. As pointed out that earlier, in each form of the invention, per FIGS. 2 and 3, the dimension 46 of each principal aperture 16 in direction 30 transverse to the direction 14 is determined substantially by the overall width 44 of the loops. Consequently, although the form of construction shown in FIG. 3 uses the least amount of material, it has been found that it is not appropriate when the width 44 of the loops in the direction 30 is greater than 650 mm. Similarly the construction of FIG. 2 is preferred to the construction of FIG. 3 when the width 44 of the loops in the direction 30 is in excess of 550 mm. It is to be understood that there is no absolute cut off point at which one form of construction is clearly to be preferred above another for the determining factor is the amount of security or deterrent effect which is required.

The savings in barbed tape material which are achieved with the constructions shown in FIGS. 2 and 3 are substantial. For a width 44 of 700 mm the construction shown in FIG. 1 has a mass of 12.5 kg for a length of 14.46 meters measured in the direction 14, i.e., a weight/length ratio of 0.86. Using identical barbed tape material the construction shown in FIG. 2 has a mass of 9.5 kg for a length of 15.1 meters in the direction 14 for a weight/length ratio of 0.63. Similar savings are achieved when the construction of FIG. 3 is compared to the construction of FIG. 1.

Substantial additional savings of costs can be achieved when the adjacent or overlying portions of the loops of barbed tape are secured to one another so that they are retained in the substantially co-planar configuration which has been described.

As noted earlier, the principal apertures 16 are the most vulnerable and consequently these should be strengthened as far as possible. The smaller peripheral apertures 18 are less vulnerable, and are more numerous, and therefore do not have to be strengthened to the same extent.

FIG. 4 shows two barbed tape lengths 50 and 52 which cross one another and which are secured together at their intersection by means of a wire tie 56. The wire tie is relatively inexpensive and the barbed tape lengths are quickly secured to one another. The construction shown in FIG. 4 is therefore used for securing the barbed tape lengths to one another at locations 70 on the peripheries of the fencing components.

FIG. 5 shows the manner in which barbed tape lengths 58 and 60, which bound the central apertures 16, are secured to one another at locations 72. For this purpose use is made of metallic dovetail bands 62 which are deformed into position using special tooling. The bands are far heavier and stronger than the wire ties 56 and consequently the fencing components are significantly reinforced in their central regions. On the other hand the bands are more expensive than the wire ties 56 but the additional expense is warranted by the benefits which result.

Although in absolute terms the cost of a wire tie 56 is not materially less than the cost of a band 62, in percentage terms the difference is significant and when account is taken of the number of clips which are used in constructing a fencing component then the cost savings become more apparent. For example with a fencing component of width 900 mm, using the construction shown in FIG. 2, approximately 142 wire ties and 120 bands are used for every 15 meters of length. Thus instead of using the bands at each joint, and by replacing the bands at the less vulnerable joints with the cheaper clips, a substantial savings in cost is achieved without compromising the efficacy of the fencing component.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A fencing component, comprising:

a continuous length of barbed tape, disposed in a plurality of loops overlying each other in a substantially coplanar manner wherein successive loops are progressively spaced relative to one another in a first direction; and means securing overlying loops to one another at selected intersections therebetween, wherein each individual loop comprises a first curved section which extends generally in a forward direction which is transverse to the said first direction, and a second curved section which extends generally in a return direction which is also transverse to the said first direction, the first curved section of each loop being spaced from the first curved section of the immediately preceding loop by a predetermined distance and from the second curved section of the preceding loop by a distance which is less than three times said predetermined distance.

2. A fencing component according to claim 1, wherein:

the spacing between the first curved section of each loop and the second curved section of a preceding loop is twice said predetermined distance.

3. A fencing component according to claim 2, wherein:

width of each loop, transverse to said first direction, is greater than 550 mm.

4. A fencing component according to claim 1, wherein:

the spacing between the first curved section of each loop and the second cured section of a preceding loop is equal to said predetermined distance.

5. A fencing component according to claim 4, wherein:

the width of each loop, transverse to the said first direction, is less than 650 mm.

6. A fencing component according to claim 1, wherein:

the securing means includes a plurality of metallic bands which respectively secure central portions of the first curved sections of the loops to intersecting central portions of the second curved sections of respective preceding loops.

7. A fencing component according to claim 1, wherein:

the securing means includes a plurality of wire ties which respectively secure overlying portions of the loops to one another at intersections therebetween near to outer peripheries of the loops.

8. A fencing component according to claim 1, wherein:

said barbed tape is initially formed as a helical coil which is extended and then arranged so that the loops of the coil are disposed to be substantially coplanar with respect to each other.

* * * * *